US012540729B2

(12) United States Patent
Lu et al.

(10) Patent No.: US 12,540,729 B2
(45) Date of Patent: Feb. 3, 2026

(54) METHOD AND APPARATUS FOR IMPROVING STEAM OXIDATION RESISTANCE OF SMALL DIAMETER BOILER TUBE IN COAL-FIRED BOILER

(71) Applicant: XI'AN THERMAL POWER RESEARCH INSTITUTE CO., LTD., Shaanxi (CN)

(72) Inventors: Jintao Lu, Xi'an (CN); Jinyang Huang, Xi'an (CN); Xingxing Zhang, Xi'an (CN); Zhen Yang, Xi'an (CN); Yongli Zhou, Xi'an (CN); Yingying Dang, Xi'an (CN); Limin Li, Xi'an (CN); Yong Yuan, Xi'an (CN)

(73) Assignee: XI'AN THERMAL POWER RESEARCH INSTITUTE CO., LTD., Shaanxi (CN)

( * ) Notice: Subject to any disclaimer, the term of this patent is extended or adjusted under 35 U.S.C. 154(b) by 209 days.

(21) Appl. No.: 18/570,014

(22) PCT Filed: Aug. 9, 2023

(86) PCT No.: PCT/CN2023/111967
§ 371 (c)(1),
(2) Date: Dec. 13, 2023

(87) PCT Pub. No.: WO2024/087798
PCT Pub. Date: May 2, 2024

(65) Prior Publication Data

US 2025/0093022 A1 Mar. 20, 2025

(30) Foreign Application Priority Data

Oct. 27, 2022 (CN) ..... 202211325248.6

(51) Int. Cl.
*F22B 37/10* (2006.01)
*C23C 24/10* (2006.01)

(52) U.S. Cl.
CPC ..... *F22B 37/108* (2013.01); *C23C 24/106* (2013.01)

(58) Field of Classification Search
None
See application file for complete search history.

(56) References Cited

U.S. PATENT DOCUMENTS

| | | | |
|---|---|---|---|
| 4,075,376 | A | 2/1978 | Jaeger |
| 7,093,360 | B1 | 8/2006 | Craig |
| 2019/0126329 | A1 | 5/2019 | Urakami |

FOREIGN PATENT DOCUMENTS

| | | | |
|---|---|---|---|
| CN | 1641255 | A | 7/2005 |
| CN | 1821649 | A | 8/2006 |

(Continued)

OTHER PUBLICATIONS

First Office Action dated Mar. 19, 2024 for Chinese Patent application No. 202211325248.6.

(Continued)

*Primary Examiner* — Michael P. Rodriguez
(74) *Attorney, Agent, or Firm* — Maschoff Brennan

(57) ABSTRACT

This application relates to the technical field of coal-fired boilers, and provides a method and an apparatus for improving steam oxidation resistance of a small-diameter boiler tube in a coal-fired boiler. The method includes the following steps: cutting a boiler tube panel from a ceiling of the boiler, vertically hoisting and fixing the boiler tube panel, and cutting out a section from a bottom portion of a lower bend of the boiler tube panel; cleaning an inner tube wall of each tube body in the boiler tube panel; performing oxidation resistance coating sintering on the inner tube wall of each tube body in the boiler tube panel; and performing a (Continued)

welding repair on each tube body in a sintered boiler tube panel. All construction processes of this method can be completed in a furnace during shutdown and maintenance, production efficiency is high, and maintenance duration can be significantly reduced. In addition, a steam oxidation resistance layer can be formed on an inner wall of the small-diameter boiler tube, so that a steam oxidation resistance capability of a small-diameter boiler tube in a service coal-fired boiler can be greatly improved.

5 Claims, 9 Drawing Sheets

(56) References Cited

FOREIGN PATENT DOCUMENTS

| | | | | | |
|---|---|---|---|---|---|
| CN | 102312188 | A | | 1/2012 | |
| CN | 104259067 | A | | 1/2015 | |
| CN | 104372338 | A | | 2/2015 | |
| CN | 106140587 | A | | 11/2016 | |
| CN | 106540831 | A | | 3/2017 | |
| CN | 106824638 | A | | 6/2017 | |
| CN | 107052349 | A | * | 8/2017 | ..... B22F 7/04 |
| CN | 206778786 | U | | 12/2017 | |
| CN | 207334707 | U | | 5/2018 | |
| CN | 208457440 | U | | 2/2019 | |
| CN | 109676539 | A | | 4/2019 | |
| CN | 109881196 | A | | 6/2019 | |
| CN | 110253450 | A | | 9/2019 | |
| CN | 210122588 | U | | 3/2020 | |
| CN | 111230750 | A | | 6/2020 | |
| CN | 211099765 | U | | 7/2020 | |
| CN | 111926284 | A | | 11/2020 | |
| CN | 212328709 | U | | 1/2021 | |
| CN | 212841655 | U | | 3/2021 | |
| CN | 212856330 | U | | 4/2021 | |
| CN | 112756238 | A | | 5/2021 | |
| CN | 112795219 | A | | 5/2021 | |
| CN | 112944109 | A | | 6/2021 | |
| CN | 113280626 | A | | 8/2021 | |
| CN | 214052943 | U | | 8/2021 | |
| CN | 214133154 | U | | 9/2021 | |
| CN | 114543580 | A | | 5/2022 | |
| CN | 115094513 | A | | 9/2022 | |
| CN | 115584494 | A | | 1/2023 | |
| CN | 218596514 | U | | 3/2023 | |
| DE | 10016510 | A1 | | 10/2001 | |
| GB | 256453 | A | | 8/1926 | |
| JP | 2003-334758 | A | | 11/2003 | |
| JP | 2004-92987 | A | | 3/2004 | |
| WO | 01/75351 | A1 | | 10/2001 | |

OTHER PUBLICATIONS

Second Office Action dated Aug. 7, 2024 for Chinese Patent application No. 202211325248.6.

Search Report dated Jan. 22, 2025 for European Patent application No. 23817009.6.

* cited by examiner

METHOD AND APPARATUS FOR IMPROVING STEAM OXIDATION RESISTANCE OF SMALL DIAMETER BOILER TUBE IN COAL-FIRED BOILER

CROSS-REFERENCE TO RELATED APPLICATIONS

This application claims priority to Chinese Patent Application No. 202211325248.6, filed with the China National Intellectual Property Administration on Oct. 27, 2022, and entitled "METHOD AND APPARATUS FOR IMPROVING STEAM OXIDATION RESISTANCE OF SMALL-DIAMETER BOILER TUBE IN COAL-FIRED BOILER", which is incorporated herein by reference in its entirety.

TECHNICAL FIELD

This application relates to the technical field of coal-fired boilers, and specifically, to a method and an apparatus for improving steam oxidation resistance of a small-diameter boiler tube in a coal-fired boiler.

BACKGROUND

Oxidation and corrosion problems on a surface of a heat exchanger tube in a high-temperature section of a boiler have long plagued safe operation of thermal power generating set. Accidents of tube blockage and tube explosion caused by the problems account for a large proportion of unplanned shutdown of the set. In addition, with the development of an advanced supercritical thermal power generating technology at 630° C. to 700° C., problems of oxidation and corrosion of a heat exchanger tube in a boiler with higher steam parameters will become more serious. Based on features and usage environments of the heat exchanger tube in the boiler of the thermal power generating set, a coating material and a corresponding preparation process that can be used to completely resolve the problems of oxidation and corrosion of the heat exchanger tubes have been developed. However, a most critical link in the preparation process is to carry out corresponding heat treatment on the heat exchanger tube, so that an effective coating structure resistant to high-temperature oxidation and corrosion can be obtained.

A heat exchanger of a boiler in the prior art includes small-diameter boiler tubes that are welded to each other. To perform heat treatment on the heat exchanger tubes, all the tubes need to be removed and cut into individual tubes, so that heat treatment can be performed on the tubes one by one in a traditional heat treatment manner. Not only costs are high and efficiency is low, but also tubes obtained after heat treatment need to be re-welded, assembled, and installed. A large quantity of welding lines and defects have posed safety hazards on the re-use of the heat exchanger tubes, and an oxide scale problem on a steam side of the thermal power generating set is a major safety hazard that leads to accidents such as tube blockage and tube explosion in the boiler. Data shows that a quantity of oxide scales peeling off in a steam pipeline on a heating surface of a 600 MW ultra-supercritical boiler is in tons. These oxide scales not only block superheater/reheater to cause a tube explosion accident, but also are carried out of the boiler by high-flow steam to damage a turbine blade. In an ultra-supercritical thermal power generating set, a component with a greatest protection requirement is mainly a small-diameter boiler tube that transmits high-temperature and high-pressure steam. The small-diameter boiler tube is used in large quantities and has a design life of not less than 20 years. For example, a boiler tube in a superheater/reheater of a 1000 MW set has an inner diameter of 20 mm to 50 mm, a length of 8 m to 12 m, a large quantity of bends of a tube panel, and usage of more than 1,000 tons. With development of advanced ultra-supercritical thermal power generating technology at 630° C. to 700° C. in the near future, the oxide scale problem with higher steam parameters will become increasingly severe.

Although a $Cr_2O_3$ film required for oxidation resistance can quickly grow on austenitic steel based on technologies such as grain refinement, inner wall shot blasting, and high-Cr alloying, stability of $Cr_2O_3$ in steam at above 600° C. is relatively poor. A problem of a loose oxide film caused by a volatile product in an oxygenated set is more serious. As a service time increases, when Cr content required during growth of the oxidation film cannot be replenished, oxidation resistance of an alloy also decreases sharply. Although 25% Cr austenitic steel has an excellent oxidation resistance/corrosion property, relatively poor structural stability reduces high-temperature endurance strength of the alloy. Martensitic heat-resistant steel tubes also face the same problem when serving in high-temperature areas. A thickness of a surface oxide scale of 9% Cr-based martensitic heat-resistant steel can reach 200 μm after the 9% Cr-based martensitic heat-resistant steel is thermally exposed to pure water vapor at 650° C. and normal pressure for 1000 hours. A loose and porous $Fe_3O_4$ layer is extremely easy to fall off, which greatly reduces reliability of safe operation of the ultra-supercritical thermal power generating set at 600° C. Therefore, how to improve a steam oxidation resistance capability of a small-diameter boiler tube in a coal-fired boiler based on an existing selected material is of great significance.

SUMMARY OF THE INVENTION

Therefore, this application provides a method and an apparatus for improving steam oxidation resistance of a small-diameter boiler tube in a coal-fired boiler, to resolve a technical problem that is how to improve a steam oxidation resistance capability of the small-diameter boiler tube in the coal-fired boiler based on an existing selected material.

To resolve the foregoing technical problem, technical solutions of this application are as follows.

A method for improving steam oxidation resistance of a small-diameter boiler tube in a coal-fired boiler includes the steps of cutting a boiler tube panel from a ceiling of the boiler, vertically hoisting and fixing the boiler tube panel, and cutting out a section from a bottom portion of a lower bend of the boiler tube panel; cleaning an inner tube wall of each tube body in the boiler tube panel; performing oxidation resistance coating sintering on the inner tube wall of each tube body in the boiler tube panel; and performing a welding repair on each tube body in a sintered boiler tube panel.

Optionally, the step of cleaning an inner tube wall of each tube body in the boiler tube panel specifically includes: removing, by using a sandblasting device, oxide scale growing on an inner wall of each boiler tube in a service tube panel, where a sand material sprayed by the sandblasting device includes one or more of brown corundum, white corundum, and quartz sand, and the sand material has a particle size less than 500 mesh.

Optionally, the step of performing oxidation resistance coating sintering on the inner tube wall of each tube body in the boiler tube panel specifically includes: coating a sandblasted boiler tube with paint by using a coating device; sintering, by using a panel-type integral heating, curing and sintering device, the boiler tube with the paint, to form an oxidation resistance coating on the inner tube wall of the boiler tube; and cleaning a residue from a sintered boiler tube by using the sandblasting device.

Optionally, the paint is prepared by using aluminum powder and nickel powder with a mass ratio of 1:1 as a penetrating agent, a phosphate aqueous solution as a solvent, $CrO_3$ as an acid inhibitor, and MgO as a curing agent, and is prepared according to the following formula: 100 g penetrating agent: 100 ml phosphate aqueous solution: 10 g acid inhibitor: 2 g curing agent.

Optionally, a coating thickness of the paint is in a range from 0.2 mm to 0.3 mm.

An apparatus for improving steam oxidation resistance of a small-diameter boiler tube in a coal-fired boiler includes at least: a sandblasting device, adapted to remove oxide scale growing on an inner wall of each boiler tube in a service tube panel; a coating device, adapted to coat a sandblasted boiler tube with paint; and a panel-type integral heating, curing and sintering device, adapted to sinter the boiler tube coated with the paint, to form an oxidation resistance coating on an inner tube wall of the boiler tube.

Optionally, the sandblasting device includes a hollow motor, a first nozzle, and a sand material tube; the hollow motor is connected to the first nozzle, and is adapted to drive the first nozzle to rotate, so that a sand material in a cavity of the first nozzle is ejected through a strip opening on a surface of the first nozzle; and one end of the sand material tube passes through the hollow motor and extends into the cavity of the first nozzle, and the other end is adapted to be communicated with an external sand material source.

Optionally, the sandblasting device further includes a traction rope, one end of the traction rope is connected to an end of the hollow motor away from the first nozzle, and the other end is adapted to be connected to an external traction device, so that the external traction device drives, by using the traction rope, the sandblasting device to move within the boiler tube.

Optionally, an annular sealing ring is sleeved on an outer wall of the hollow motor and/or an outer wall of the first nozzle, and an outer diameter of the annular sealing ring is consistent with an inner diameter of the boiler tube.

Optionally, the coating device includes a drive mechanism and a coating mechanism that are connected, the drive mechanism is adapted to drive the coating mechanism to move within the boiler tube, and the coating mechanism is adapted to coat the inner wall of the boiler tube with the paint.

Optionally, the drive mechanism includes a first housing, driving wheels, and a power battery; the several driving wheels are disposed at intervals on an outer wall of the first housing along a circumferential direction of the first housing, and each of the driving wheels can telescopically move along a radial direction of the first housing; and the power battery is disposed in the first housing, is electrically connected to each of the driving wheels, and is adapted to drive the driving wheel to rotate.

Optionally, the coating mechanism includes a second housing, a second nozzle, a pneumatic motor, an air pipe, and a feed pipe; the second housing is connected to the first housing, and the second nozzle is disposed at an end of the second housing away from the first housing; the pneumatic motor is disposed in the second housing, an air outlet of the pneumatic motor is communicated with an air inlet of the second nozzle, and the air inlet of the pneumatic motor is communicated with an external air source through the air pipe; and one end of the feed pipe is communicated with a feeding port of the second nozzle, and the other end is communicated with an external paint source.

Optionally, several locating wheels are disposed at intervals on an outer wall of the second housing along a circumferential direction of the second housing, and each of the locating wheels can telescopically move along a radial direction of the second housing.

Optionally, the coating device further includes a front camera, a rear camera, and a thickness measurement sensor that are adapted to monitor a coating process; the front camera is disposed at the end of the second housing away from the first housing; the rear camera is disposed at an end of the first housing away from the second housing; and the thickness measurement sensor is disposed at the end of the second housing away from the first housing.

Optionally, the panel-type integral heating, curing and sintering device includes an air-cooled induction heating coil, a coil movement track, a crawler, an intelligent control cabinet, and an induction coil power supply; one end of the coil movement track is adapted to be disposed on a ceiling of the boiler, and the other end vertically extends downward and beyond a bottom portion of the boiler tube; the crawler is disposed on an inner side of the coil movement track, and the air-cooled induction heating coil is connected to the crawler; the induction coil power supply is electrically connected to the air-cooled induction heating coil; and the intelligent control cabinet is electrically connected to the crawler, and the intelligent control cabinet controls the crawler to drive the air-cooled induction heating coil to move along the coil movement track, to sinter the boiler tube located in the air-cooled induction heating coil.

Optionally, the panel-type integral heating, curing and sintering device further includes a first limiter and a second limiter; and the first limiter and the second limiter are disposed at intervals on the coil movement track, to limit operation starting and ending locations of the crawler on the coil movement track.

The technical solutions of this application have the following advantages:

In the method for improving steam oxidation resistance of a small-diameter boiler tube in a coal-fired boiler provided in this application, first, the boiler tube panel is cut from the ceiling of the boiler, and is vertically hoisted and fixed, and the section is cut out from the bottom portion of the lower bend of the boiler tube panel. Then, the inner tube wall of each tube body in the boiler tube panel is cleaned. Next, oxidation resistance coating sintering is performed on the inner tube wall of each tube body in the boiler tube panel. Finally, the welding repair is performed on each tube body in the sintered boiler tube panel. All construction processes of this method can be completed in a furnace during shutdown and maintenance, production efficiency is high, and maintenance duration can be significantly reduced. In addition, a steam oxidation resistance layer can formed on the inner wall of the small-diameter boiler tube, so that a steam oxidation resistance capability of a small-diameter boiler tube in a service coal-fired boiler can be greatly improved.

BRIEF DESCRIPTION OF THE DRAWINGS

To more clearly illustrate the specific implementations of this application or the technical solutions in the prior art, the following briefly describes the accompanying drawings that are required for describing the specific implementations or the prior art. Obviously, the accompanying drawings described below are some implementations of this application. A person of ordinary skill in the art may further obtain other accompanying drawings based on the accompanying drawings without creative efforts.

Figure 1:
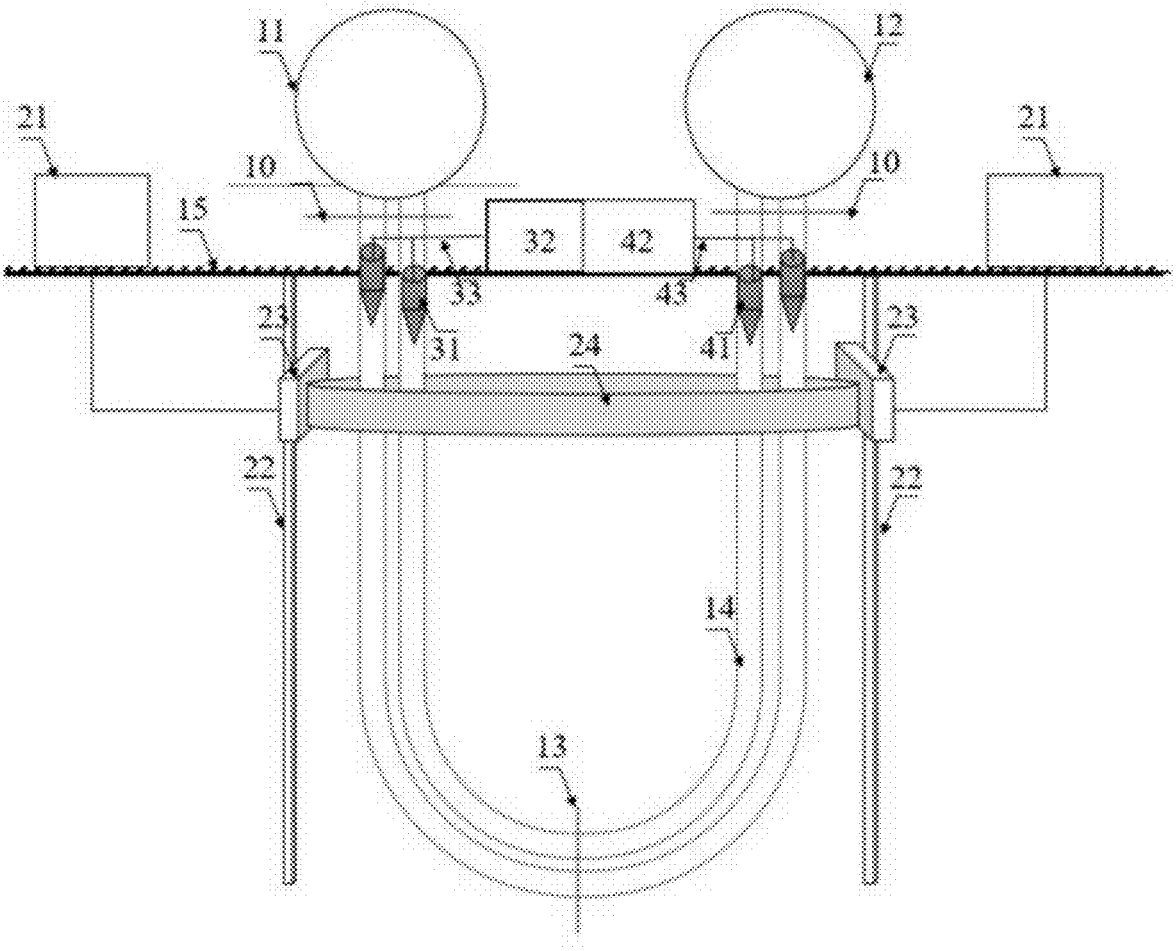
FIG. 1 is a schematic diagram of an overall structure of an apparatus for improving steam oxidation resistance of a small-diameter boiler tube in a coal-fired boiler according to an embodiment of this application.

The Figures include various elements, each element notated with an element number. Examples of the elements and element numbers may include,

10. ceiling cutting surface; 11. entrance header; 12. exit header; 13. lower bend cutting surface; 14. tube panel; 15. ceiling of a boiler; 21. induction coil power supply; 22. coil movement track; 23. crawler; 24. air-cooled induction heating coil; 25. intelligent control cabinet; 31. sandblasting device; 32. sand material storage tank; 33. sand material tube; 41. coating device; 42. paint storage tank; 43. feed pipe; 44. air pipe;

221. track slot; 222. track sliding ball; 231. first limiter; 232. second limiter; 233. coil fixing bolt; 234. first cable inlet; 235. second cable inlet; 236. drive motor; 237. boss;

311. hollow motor; 312. first nozzle; 313. first connector; 314. annular sealing ring; 315. strip opening; 316. traction rope; 317. conducting wire; 321. first interface; 3131. first coupling; 3211. tight nut; and

411. drive mechanism; 412. coating mechanism; 413. driving wheel; 414. first housing; 415. rear camera; 416. second connector; 417. locating wheel; 418. second nozzle; 419. pneumatic motor; 420. front camera; 421. second housing; 422. second coupling; 423. thickness measurement sensor; 4131. first wheel; 4132. direct current motor; 4133. hydraulic telescopic rod; 4134. hydraulic tank; 4135. power battery; 4171. second wheel; 4172. sliding rod; 4173. sliding cavity; 4174. compression spring.

DETAILED DESCRIPTION

Technical solutions of this application are clearly and completely described below with reference to the accompanying drawings. Obviously, the described embodiments are some, but not all, of the embodiments of this application. All other embodiments obtained by a person of ordinary skill in the art based on the embodiments of this application without creative efforts shall fall within the protection scope of this application.

In the descriptions of this application, it should be noted that an orientation or positional relationship indicated by terms "center", "upper", "lower", "left", "right", "vertical", "horizontal", "inner", "outer", and the like is based on an orientation or positional relationship shown in the accompanying drawings, and is only for the convenience of describing this application and simplifying the descriptions, rather than indicating or implying that the indicated apparatus or component must have a specific orientation or must be constructed and operated in a specific orientation. Therefore, the orientation or positional relationship should not be construed as limitations on this application. Furthermore, terms "first", "second", and "third" are used for descriptive purposes only and should not be construed to indicate or imply relative importance.

In the descriptions of the embodiments of this application, unless otherwise specified and defined explicitly, the terms "mount", "connect", and "join" should be understood in their general senses. For example, they may refer to a fixed connection, a detachable connection, or an integral connection, may refer to a mechanical connection or an electrical connection, and may refer to a direct connection, an indirect connection via an intermediate medium, or an internal communication between two elements. For a person of ordinary skill in the art, specific meanings of the foregoing terms in this application may be understood based on a specific situation.

In addition, the technical features involved in the different implementations of this application that are described below can be combined with each other as long as the technical features do not conflict with each other.

FIG. 1 is a schematic diagram of an overall structure of an apparatus for improving steam oxidation resistance of a small-diameter boiler tube in a coal-fired boiler according to an embodiment of this application. As shown in FIG. 1, in this embodiment, when a boiler tube panel is cut at a ceiling, a location of a ceiling cutting surface 10 and a location of a lower bend cutting surface 13 are shown in FIG. 1, so that the boiler tube panel 14 is separated from an entrance header 11 and an exit header 12. Cutting and separation are performed at a lowest point of a lower bend of the boiler tube panel 14, and the cut boiler tube panel 14 is hoisted and fixed by using a hoisting device in a furnace.

In this embodiment, an induction coil power supply 21, a sand material storage tank 32, and a paint storage tank 42 are installed on the ceiling 15 of the boiler. The sand material storage tank 32 is connected to a sandblasting device 31 through a sand material tube 33. The paint storage tank 42 may be communicated with a coating device 41 through a feed pipe 43.

In this embodiment, both the sandblasting device 31 and the coating device 41 may be delivered from an upper cutting surface opening of the boiler tube panel 14 into a tube for operation.

As shown in FIG. 1, this embodiment provides an apparatus for improving steam oxidation resistance of a small-diameter boiler tube in a coal-fired boiler, including at least: a sandblasting device 31, adapted to remove oxide scale growing on an inner wall of each boiler tube in a service tube panel 14; a coating device 41, adapted to coat a sandblasted boiler tube with paint; and a panel-type integral heating, curing and sintering device, adapted to sinter the boiler tube coated with the paint, to form an oxidation resistance coating on an inner tube wall of the boiler tube.

In the apparatus for improving steam oxidation resistance of a small-diameter boiler tube in a coal-fired boiler in this embodiment, the oxide scale growing on the inner wall of each boiler tube in the service tube panel 14 may be first removed by using the sandblasting device 31; then the sandblasted boiler tube is coated with the paint by using the coating device 41; and finally, the boiler tube coated with the paint is sintered by using the panel-type integral heating, curing and sintering device, to form the oxidation resistance coating on the inner tube wall of the boiler tube. In this case, a steam oxidation resistance capability of a small-diameter boiler tube in a service coal-fired boiler can be greatly improved.

Figure 2:
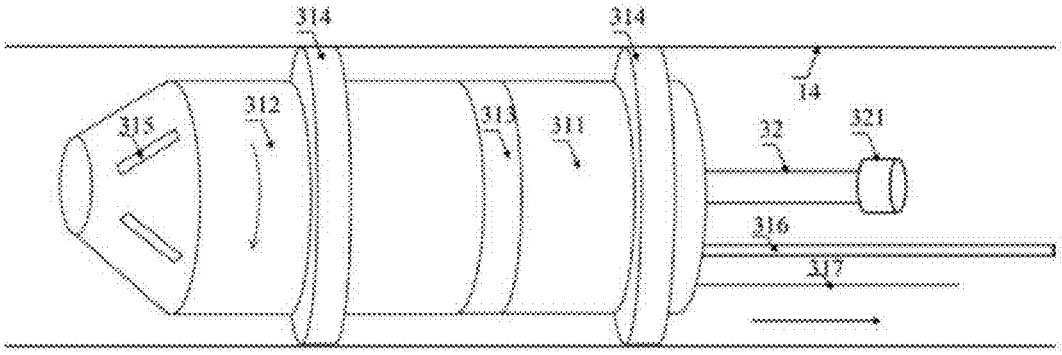
FIG. 2 is a schematic diagram of a sandblasting device in FIG. 1.
Figure 3:
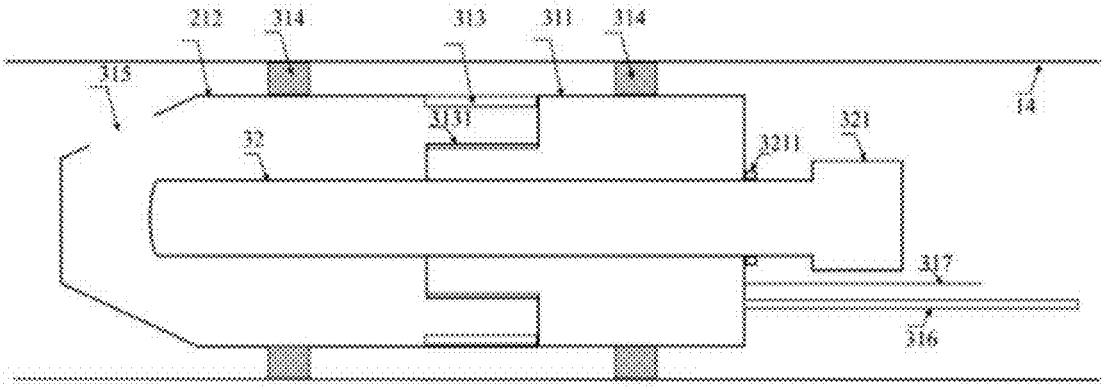
FIG. 3 is a sectional view of FIG. 2.

FIG. 2 is a schematic diagram of a sandblasting device in FIG. 1. FIG. 3 is a sectional view of FIG. 2. As shown in FIG. 2 and FIG. 3, the sandblasting device 31 includes a hollow motor 311, a first nozzle 312, and a sand material tube 33. The hollow motor 311 is connected to the first nozzle 312, and is adapted to drive the first nozzle 312 to rotate, so that a sand material in a cavity of the first nozzle 312 is ejected through a strip opening 315 on a surface of the first nozzle 312. One end of the sand material tube 33 passes through the hollow motor 311 and extends into the cavity of the first nozzle 312, and the other end is adapted to be communicated with an external sand material source.

The sandblasting device 31 further includes a traction rope 316, one end of the traction rope 316 is connected to an end of the hollow motor 311 away from the first nozzle 312, and the other end is adapted to be connected to an external traction device, so that the external traction device drives, by using the traction rope 316, the sandblasting device 31 to move within the boiler tube.

An annular sealing ring 314 is sleeved on an outer wall of the hollow motor 311 and/or an outer wall of 312 the first nozzle 312, and an outer diameter of the annular sealing ring 314 is consistent with an inner diameter of the boiler tube.

Specifically, the hollow motor 311 is located at a rear section of the entire sandblasting device 31, is connected to an external power supply through a conducting wire 317, and is connected to the external traction device through the traction rope 316. The first nozzle 312 is disposed at a front section of the sandblasting device 31 and is coaxially connected in series to the hollow motor 311 by using a first connector 313 and a first coupling 3131, so that axes of the two connected parts are consistent. The sand material tube 33 passes through interior of the hollow motor 311 and interior of the first nozzle 312, and an axial position of the sand material tube 33 is fixed by using a tight nut 3211. A first interface 321 may be disposed at a tail portion of the sand material tube 33 and is connected to an external sand material storage tank 32.

The hollow motor 311 may use a direct current power supply, and the conducting wire 317 is connected to the external power supply. The first coupling 3131 is disposed inside the hollow motor 311, and is used to connect the hollow motor 311 and the first nozzle 312. Rotation of the hollow motor 311 drives the first nozzle 312 to rotate at a high speed, and a no-load speed of the hollow motor 311 is greater than 30,000 revolutions per minute. A head of the first nozzle 312 may be of a conical structure, and a conical surface is provided with a plurality of strip openings 315. A sand material is ejected from the strip opening 315 onto the inner wall of the boiler tube by using centrifugal force generated through high-speed rotation of the first nozzle 312. A section that connects the first nozzle 312 and the hollow motor 311 may be a cylindrical hollow shell, and the cylindrical hollow shell may be coaxially connected to the hollow motor 311. In addition, for a hollow structure of the first nozzle 312, a small quantity of sand materials may be stored in the cavity. Continuous sandblasting operations may also be ensured even when sand materials are unstably supplied. An equal-diameter annular sealing ring 314 is installed on an outer side of the hollow motor 311 and an outer side of the first nozzle 312. A diameter of the annular sealing ring 314 is adjusted, to implement close fit with the inner wall of the boiler tube, to ensure that the entire sandblasting device 31 is always located in a center of the tube during advancement.

To ensure sandblasting cleaning quality, the sandblasting device 31 works in a backward coating manner during use. Before a sandblasting operation, the diameter of the annular sealing ring 314 is adjusted, the sandblasting device 31 is placed into an inner cavity of a boiler tube to be sandblasted, and the sandblasting device 31 advances to a front end of the boiler tube to be sandblasted. After the external sand material storage tank 32, the traction device, and the power supply for the hollow motor 311 are connected, a sandblasting operation speed is adjusted by controlling an operating speed of the external traction device. The sand material used by the sandblasting device 31 may be corundum sand, quartz sand, and other blast sand materials, and the sand material should have a particle size less than 500 mesh.

Figure 4:
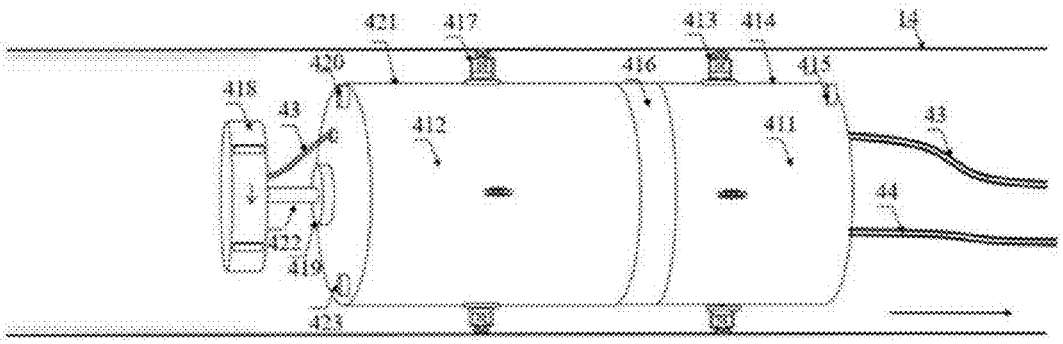
FIG. 4 is a schematic diagram of a coating device in FIG. 1.
Figure 5:
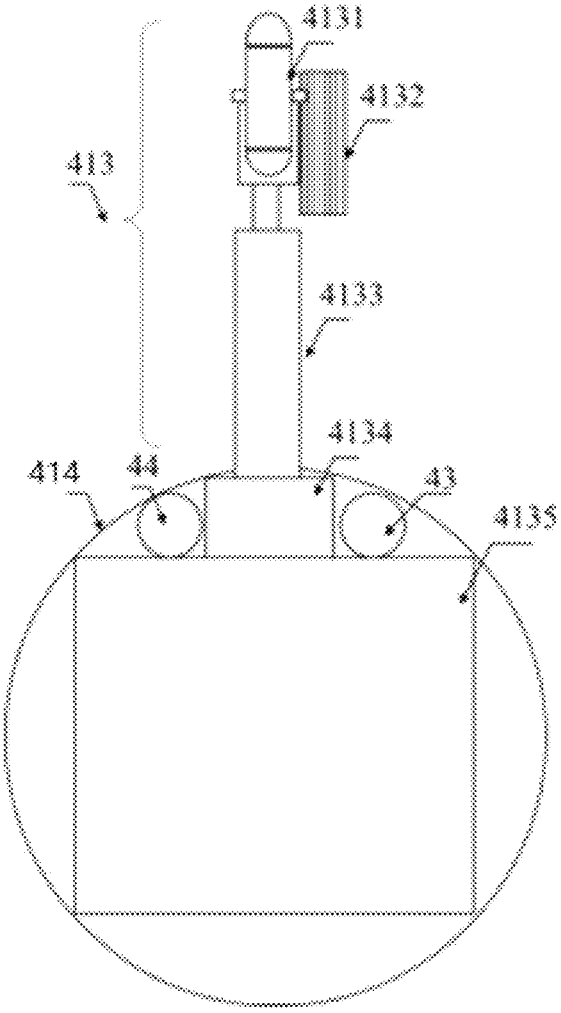
FIG. 5 is an enlarged schematic diagram of a driving wheel in FIG. 4.
Figure 6:
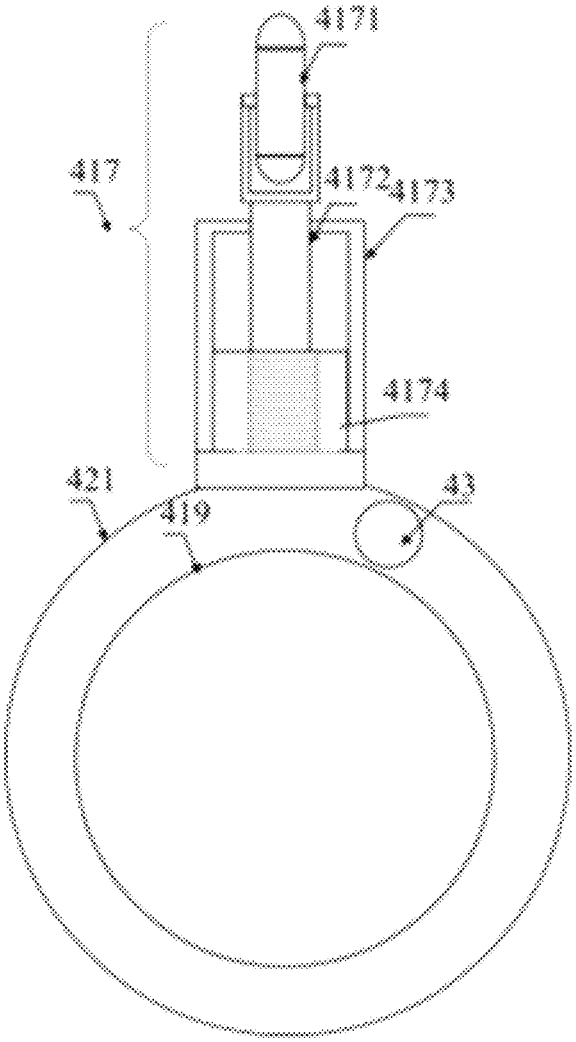
FIG. 6 is an enlarged schematic diagram of a locating wheel in FIG. 4.

FIG. 4 is a schematic diagram of the coating device in FIG. 1. FIG. 5 is an enlarged schematic diagram of a driving wheel in FIG. 4. FIG. 6 is an enlarged schematic diagram of a locating wheel in FIG. 4. As shown in FIG. 4, FIG. 5, and FIG. 6, the coating device 41 includes a drive mechanism 411 and a coating mechanism 412 that are connected. The drive mechanism 411 is adapted to drive the coating mechanism 412 to move within a boiler tube, and the coating mechanism 412 is adapted to coat an inner wall of the boiler tube with paint.

The drive mechanism 411 includes a first housing 414, driving wheels 413, and a power battery 4135. The several driving wheels 413 are disposed at intervals on an outer wall of the first housing 414 along a circumferential direction of the first housing 414, and each of the driving wheels 413 can telescopically move along a radial direction of the first housing 414. The power battery 4135 is disposed in the first housing 414, is electrically connected to each of the driving wheels 413, and is adapted to drive the driving wheel 413 to rotate.

The coating mechanism 412 includes a second housing 421, a second nozzle 418, a pneumatic motor 419, an air pipe 44, and a feed pipe 43. The second housing 421 is connected to the first housing 414, and the second nozzle 418 is disposed at an end of the second housing 421 away from the first housing 414. The pneumatic motor 419 is disposed within the second housing 421, an air outlet of the pneumatic motor 419 is connected to an air inlet of the second nozzle 418, and the air inlet of the pneumatic motor 419 is communicated with an external air source through the air pipe 44. One end of the feed pipe 43 is communicated with a feeding port of the second nozzle 418, and the other end is connected to an external paint source.

Optionally, several locating wheels 417 are disposed at intervals on an outer wall of the second housing 421 along a circumferential direction of the second housing 421, and each of the locating wheels 417 can telescopically move along a radial direction of the second housing 421.

The coating device 41 further includes a front camera 420, a rear camera 415, and a thickness measurement sensor 423 that are adapted to monitor a coating process. The front camera 420 is disposed at the end of the second housing 421 away from the first housing 414.

The rear camera 415 is disposed at an end of the first housing 414 away from the second housing 421. The thickness measurement sensor 423 is disposed at the end of the second housing 421 away from the first housing 414.

Specifically, the coating device 41 mainly includes a drive mechanism 411 and a coating mechanism 412, and an arrow indicates a direction of a rear end of the coating device 41. The drive mechanism 411 is located at the rear end of the coating device 41 and is used to provide power for moving forward and reversing. The drive mechanism 411 has the first housing 414, four cross-distributed drive wheels 413 disposed on the first housing 414, and the power battery 4135 in the first housing 414.

The coating mechanism 412 is disposed at a front end of the coating device 41 and is used to coat the inner wall of the boiler tube with paint. The coating mechanism 412 has the second housing 421, four cross-distributed locating wheels 417 disposed on the second housing 421, the pneumatic motor 419 disposed in the second housing 421, the second nozzle 418 disposed outside the second housing 421, and the front camera 420, the rear camera 415, and the thickness measurement sensor 423 for monitoring the coating process.

The drive mechanism 411 and the coating mechanism 412 in the coating device 41 may be connected in series by using a second connector 416, and axes of the two connected parts remain consistent. The coated paint required during use may be provided by a paint storage tank 42, and a selected carrier gas may be provided by an external air compression device.

The air pipe 44 passes through interior of the first housing 414 and interior of the second housing 421 and is connected to an interface of the air pipe 44 of the pneumatic motor 419. The feed pipe 43 passes through the interior of the first housing 414 and the interior of the second housing 421 and is connected to an interface of the feed pipe 43 of the second nozzle 418.

A hydraulic telescopic rod 4133 is disposed on the driving wheel 413, to connect the first wheel 4131 and the first housing 414. A miniature hydraulic tank 4134 is disposed at a bottom portion of the driving wheel 413 to provide pressure required by the hydraulic telescopic rod 4133. Four groups of driving wheels 413 are disposed in a cross manner and have a same structure. The power battery 4135 inside the first housing 414 is centrally placed, and space is reserved for the air pipe 44 and the feed pipe 43 to pass through.

The locating wheel 417 is used to ensure that the drive mechanism 411 and the coating mechanism 412 have a same axis and have no power function, to reduce an unnecessary control unit and connection line. The locating wheel 417 includes a second wheel 4171, a sliding cavity 4173, and a sliding rod 4172, a compression spring 4174, and a partition that are built in the sliding cavity 4173. When external force squeezes the second wheel 4171, the compression spring 4174 contracts and deforms, and elastic force is transferred by using the sliding rod 4172, to fix the second wheel 4171 on the inner wall of the boiler tube. Four groups of locating wheels 417 are disposed in a cross manner and have a same structure. The pneumatic motor 419 inside the second housing 421 is centrally placed, and space is reserved between the second housing 421 and the pneumatic motor 419 for the feed pipe 43 to pass through. An interface of the air pipe 44 is disposed at a tail portion of the pneumatic motor 419, and is used to connect to the air pipe 44. A second coupling 422 is disposed at a top portion of the pneumatic motor 419, and is used to connect to the second nozzle 418. The second nozzle 418 is provided with a strip opening, and the paint is ejected from the strip opening onto the inner wall of the boiler tube by using centrifugal force generated through high-speed rotation.

To ensure quality of a coating, the coating device 41 works through reverse coating during use. Before coating, an extension length of the hydraulic telescopic rod 4133 and an extension length of the sliding rod 4172 are adjusted, the coating device 41 is placed into an inner cavity of the boiler tube to be coated. After the external air compression device and the paint storage tank 42 are connected, the power battery 4135 is started to supply power to direct current motors 4132 of the four driving wheels 413, so that the coating device 41 advances to a front end of the boiler tube to be coated. The front camera 420, the rear camera 415, and the thickness measurement sensor 423 are turned on, to monitor a coating process.

Figure 7:
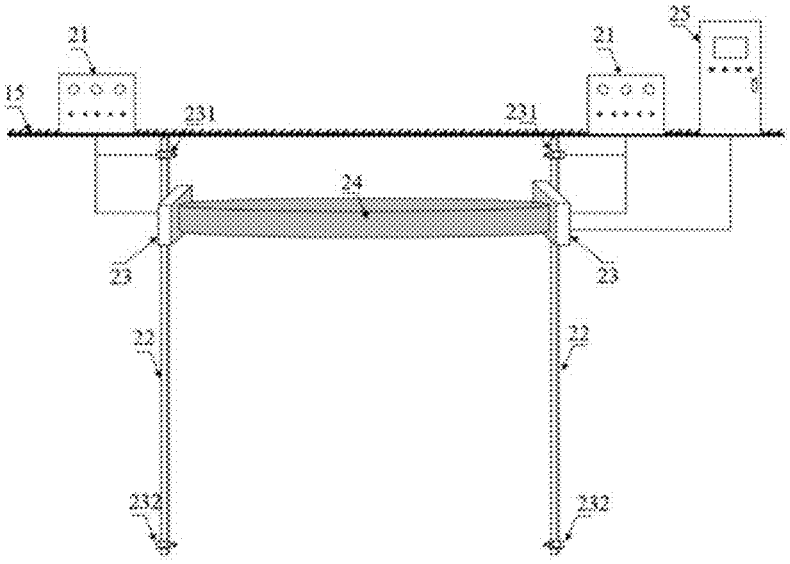
FIG. 7 is a schematic diagram of a panel-type integral heating, curing and sintering device in FIG. 1.
Figure 8:
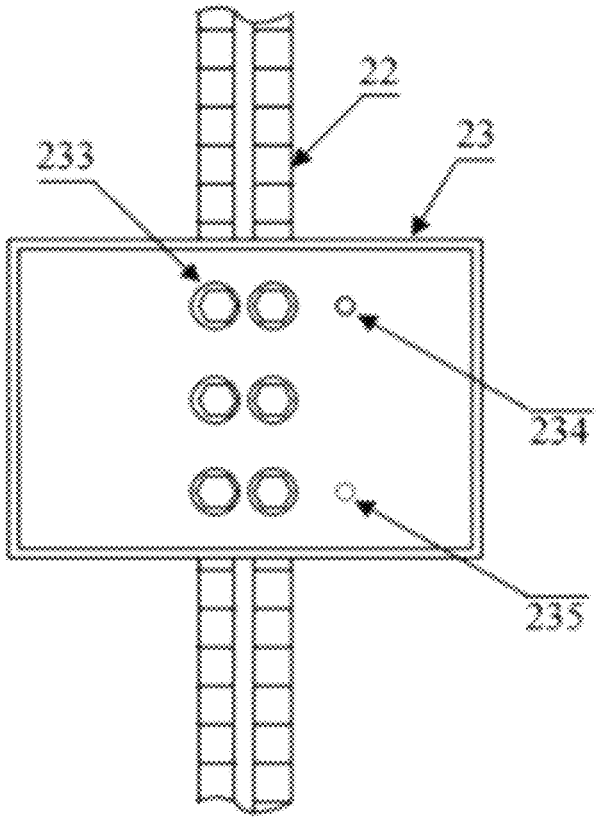
FIG. 8 is a front view of a crawler FIG. 7.
Figure 9:
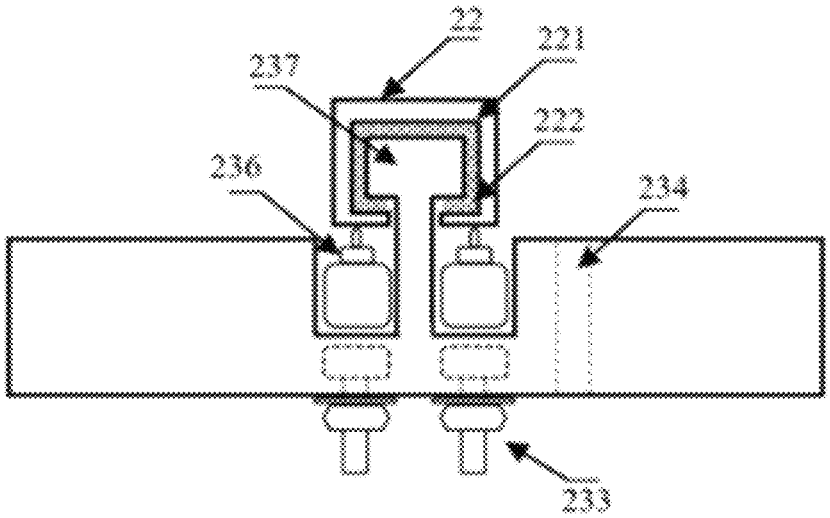
FIG. 9 is a top view of a crawler in FIG. 7.
Figure 10:
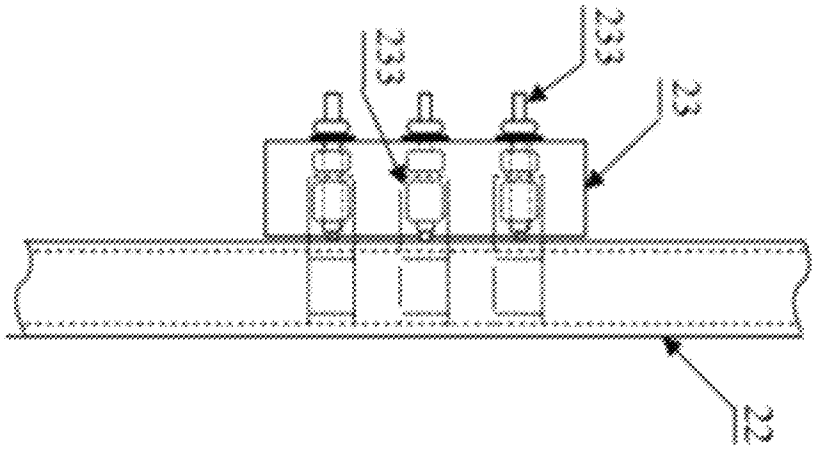
FIG. 10 is a side view of a crawler in FIG. 7.
Figure 11:
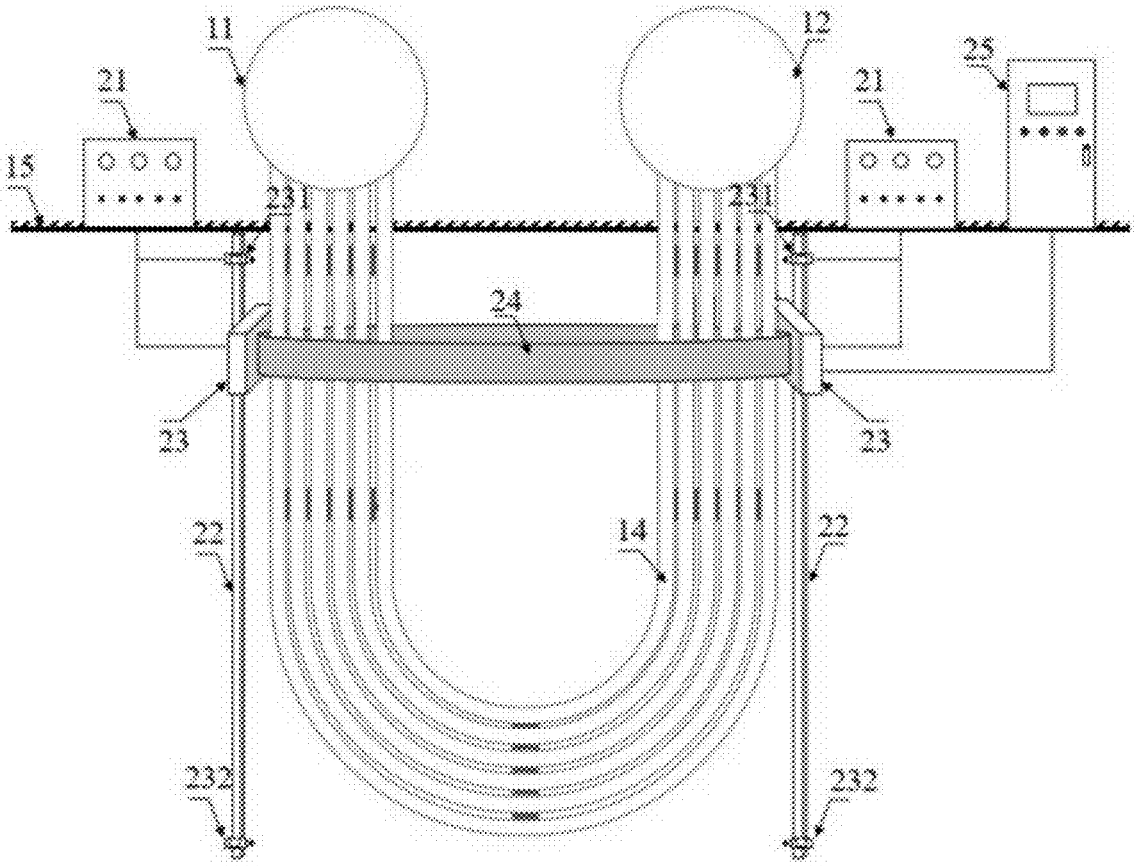
FIG. 11 is a schematic diagram of a panel-type integral heating, curing and sintering device in a working state in FIG. 7.

FIG. 7 is a schematic diagram of the panel-type integral heating, curing and sintering device in FIG. 1. FIG. 8 is a front view of a crawler in FIG. 7. FIG. 9 is a top view of the crawler in FIG. 7. FIG. 10 is a side view of the crawler in FIG. 7. FIG. 11 is a schematic diagram of the panel-type integral heating, curing and sintering device in FIG. 7 in a working state. As shown in FIG. 7, FIG. 8, FIG. 9, FIG. 10, and FIG. 11, the panel-type integral heating, curing and sintering device includes an air-cooled induction heating coil 24, a coil movement track 22, a crawler 23, an intelligent control cabinet 25, and an induction coil power supply 21. One end of the coil movement track 22 is adapted to be disposed on a ceiling 15 of the boiler, and the other end vertically extends downward and beyond a bottom portion of a boiler tube. The crawler 23 is disposed on an inner side of the coil movement track 22, and the air-cooled induction heating coil 24 is connected to the crawler 23. The coil power supply 21 is electrically connected to the air-cooled induction heating coil 24. The intelligent control cabinet 25 is electrically connected to the crawler 23. The intelligent control cabinet 25 controls the crawler 23 to drive the air-cooled induction heating coil 24 to move along the coil movement track 22, to sinter the boiler tube in the air-cooled induction heating coil 24.

The panel-type integral heating, curing and sintering device further includes a first limiter 231 and a second limiter 232. The first limiter 231 and the second limiter 232 are disposed at intervals on the coil movement track 22, to limit starting and ending locations of the crawler 23 on the coil movement track 22.

Specifically, two ends of the air-cooled induction heating coil 24 are fixed on the crawler 23. The crawler 23 is disposed on the inner side of the coil movement track 22. The intelligent control cabinet 25 is electrically connected to the crawler 23. The induction coil power supply 21 is connected to the air-cooled induction heating coil 24 by using the crawler 23. An upper end of the coil movement track 22 is fixed on the ceiling 15 of the boiler, a lower section is vertically hoisted below the bottom portion of the boiler tube, and coil movement tracks 22 are usually used in pairs. The first limiter 231 and the second limiter 232 are disposed at intervals on the coil movement track 22. The first limiter 231 may be disposed at a location that is 0.3 m below the ceiling 15 of the boiler. The second limiter 232 may be disposed at a location that is 0.5 m downward from the bottom portion of the boiler tube, and is used to automatically locate the starting and ending locations of the crawler 23. The crawler 23 is located between the first limiter 231 and the second limiter 232, and two ends maintain level.

A track slot 221 is provided on the coil movement track 22, and a track sliding ball 222 capable of 360° rolling is embedded in the track slot 221. The crawler 23 includes a coil fixing bolt 233, a drive motor 236, a boss 237, a second cable inlet 235, and a first cable inlet 234. The crawler 23 and the coil movement track 22 is connected to the track slot 221 through the boss 237. The track sliding ball 222 is used to reduce crawling resistance of the crawler 23, and the drive motor 236 provides crawling power. The drive motor 236 is set to rotate forward and reversely to enable the crawler 23 to crawl up and down. Before heat treatment is performed on the boiler tube, a system is built and installed. Large auxiliary equipment such as the induction coil power supply 21 and the intelligent control cabinet 25 are disposed on an entire heating system and fixed on the ceiling 15 of the boiler. Remaining components are vertically disposed downward in a longitudinal manner. A span size of the air-cooled induction heating coil 24 is flexibly changed based on a size of a boiler tube panel 14 and is not limited by a size of a workpiece, for example, the boiler tube panel 14.

In one of optional manners of this embodiment, the intelligent control cabinet 25 adjusts the crawler 23, so that the crawler 23 is located at the first limiter 231. Based on information such as a heat treatment temperature required by the boiler tube and a size of the boiler tube, a power, an operation speed, an operation time, and the like that are required by the air-cooled induction heating coil 24 are set, and an operation button of the intelligent control cabinet 25 is started. Under adjustment of a PLC in the intelligent control cabinet 25, the crawler 23 is driven by the drive motor 236 to start to crawl from top to bottom. When the crawler passes the first limiter 231, the induction coil power supply 21 is automatically turned on, and the air-cooled induction heating coil 24 starts to automatically perform chemical heat treatment on the tube panel 14 formed by the boiler tube. Simultaneously, as the crawler 23 continues crawling downward, after the heat treatment on the entire tube panel 14 is completed and the crawler 23 arrives at the second limiter 232, the intelligent control cabinet 25 sends a signal, the induction coil power supply 21 is automatically turned off, the induction heating stops. The crawler 23 starts to crawl from bottom to top under reverse rotation of the drive motor 236, until an initial location is restored. The intelligent control cabinet 25 stops working and the heat treatment process of the tube panel 14 is completed.

Another embodiment provides a method for improving steam oxidation resistance of a small-diameter boiler tube in a coal-fired boiler, including the steps of cutting a boiler tube panel 14 from a ceiling 15 of the boiler, vertically hoisting and fixing the boiler tube panel, and cutting out a section from a bottom portion of a lower bend of the boiler tube panel 14; cleaning an inner tube wall of each tube body in the boiler tube panel 14; performing oxidation resistance coating sintering on the inner tube wall of each tube body in the boiler tube panel 14; and performing a welding repair on each tube body in a sintered boiler tube panel 14.

In the method, provided in this embodiment, for improving steam oxidation resistance of a small-diameter boiler tube in a coal-fired boiler, first, the boiler tube panel 14 is cut from the ceiling 15 of the boiler, the boiler tube panel 14 is vertically hoisted and fixed, and the section is cut out from the bottom portion of the lower bend of the boiler tube panel 14. Then, the inner tube wall of each tube body in the boiler tube panel 14 is cleaned. Next, oxidation resistance coating sintering is performed on the inner tube wall of each tube body in the boiler tube panel 14. Finally, the welding repair is performed on each tube body in the sintered boiler tube panel 14. All construction processes of this method can be completed in a furnace during shutdown and maintenance, production efficiency is high, and maintenance duration can be significantly reduced. In addition, a steam oxidation resistance layer can be formed on an inner wall of the small-diameter boiler tube, so that a steam oxidation resistance capability of a small-diameter boiler tube in a service coal-fired boiler can be greatly improved.

The cleaning an inner tube wall of each tube body in the boiler tube panel 14 specifically includes: removing, by using a sandblasting device 31, oxide scale growing on an inner wall of each boiler tube in a service tube panel 14, where a sand material sprayed by the sandblasting device 31 includes one or more of brown corundum, white corundum, and quartz sand, and the sand material has a particle size less than 500 mesh.

The performing oxidation resistance coating sintering on the inner tube wall of each tube body in the boiler tube panel 14 specifically includes: coating a sandblasted boiler tube with paint by using a coating device 41; sintering, by using a panel-type integral heating, curing and sintering device, the boiler tube coated with the paint, to form an oxidation resistance coating on the inner tube wall of the boiler tube, where a sintering temperature may be 800° C. to 900° C., and a control heat preservation time is 10 min to 15 min; and cleaning a residue from a sintered boiler tube by using the sandblasting device 31.

The paint is prepared by using aluminum powder and nickel powder with a mass ratio of 1:1 as a penetrating agent, a phosphate aqueous solution as a solvent, $CrO_3$ as an acid inhibitor, and MgO as a curing agent, and is prepared according to the following formula: 100 g penetrating agent: 100 ml phosphate aqueous solution: 10 g acid inhibitor: 2 g curing agent.

Optionally, a coating thickness of the paint is in a range from 0.2 mm to 0.3 mm.

Obviously, the foregoing embodiments are only examples for clear description, and are not intended to limit the implementations. For a person of ordinary skill in the art, changes or modifications in other different forms can also be made on the basis of the above descriptions. There is no need and cannot be exhaustive of all implementations herein. However, obvious changes or modifications derived from this still fall within the protection scope of this application.

The invention claimed is:

1. A method for improving steam oxidation resistance of a small-diameter boiler tube in a coal-fired boiler, comprising the steps of cutting a boiler tube panel from a ceiling of the boiler, vertically hoisting and fixing the boiler tube panel, and cutting out a section from a bottom portion of a lower bend of the boiler tube panel;

cleaning an inner tube wall of each tube body in the boiler tube panel;

sintering the inner tube wall of each tube body in the boiler tube panel with an oxidation resistance coating; and performing a welding repair on each tube body in a sintered boiler tube panel, wherein the small-diameter boiler tube has a diameter ranging from 20 mm to 50 mm.

2. The method for improving steam oxidation resistance of a small-diameter boiler tube in a coal-fired boiler according to claim 1, wherein the cleaning an inner tube wall of each tube body in the boiler tube panel specifically comprises:

removing, by using a sandblasting device, oxide scale growing on an inner wall of each boiler tube in a service tube panel;

wherein a sand material sprayed by the sandblasting device comprises one or more of brown corundum, white corundum and quartz sand, and the sand material has a particle size less than 500 mesh.

3. The method for improving steam oxidation resistance of a small-diameter boiler tube in a coal-fired boiler according to claim 2, wherein the sintering the inner tube wall of each tube body in the boiler tube panel with an oxidation resistance coating specifically comprises:

coating a sandblasted boiler tube by using a coating device;

sintering a coated boiler tube by using a panel-type integral heating, curing and sintering device, to form an oxidation resistance coating on the inner tube wall of the boiler tube; and cleaning a residue from a sintered boiler tube by using the sandblasting device.

4. The method for improving steam oxidation resistance of a small-diameter boiler tube in a coal-fired boiler according to claim 3, wherein the coating is prepared according to the following formula: 100 g of a penetrating agent: 100 ml of a solvent: 10 g of an acid inhibitor: 2 g of an curing agent, the penetrating agent is aluminum powder and nickel powder with a mass ratio of 1:1, the solvent is phosphate aqueous solution, the acid inhibitor is $CrO_3$ and the curing agent is MgO.

5. The method for improving steam oxidation resistance of a small-diameter boiler tube in a coal-fired boiler according to claim 3, wherein the coating thickness of the coating is in a range from 0.2 mm to 0.3 mm.

* * * * *